United States Patent [19]

Kanero et al.

[11] 4,382,829

[45] May 10, 1983

[54] AUSTENITE ALLOY TUBES HAVING EXCELLENT HIGH TEMPERATURE VAPOR OXIDATION RESISTANT PROPERTY

[75] Inventors: Takahiro Kanero; Yusuke Minami, both of Yokohama, Japan

[73] Assignee: Nippon Kokan Kabushiki Kaisha, Tokyo, Japan

[21] Appl. No.: 210,035

[22] Filed: Nov. 24, 1980

[30] Foreign Application Priority Data

Dec. 5, 1979 [JP] Japan ..... 54-156918

[51] Int. Cl.[3] ..... C22C 38/40

[52] U.S. Cl. ..... 148/39; 148/16.6; 148/38

[58] Field of Search ..... 148/12 E, 38, 39, 16.6, 148/136, 15.5, 31.5; 75/128 N

[56] References Cited

U.S. PATENT DOCUMENTS

| | | | |
|---|---|---|---|
| 3,969,161 | 7/1976 | Mimino et al. | 148/38 |
| 4,026,699 | 5/1977 | Eiselstein et al. | 148/38 |
| 4,070,209 | 1/1978 | Usui | 148/12 E |

FOREIGN PATENT DOCUMENTS

| | | | |
|---|---|---|---|
| 479865 | 1/1952 | Canada | 148/15.5 |
| 50-44934 | 4/1975 | Japan | 148/16.6 |
| 50-115610 | 9/1975 | Japan | 148/16.6 |
| 398834 | 9/1933 | United Kingdom . | |
| 1262568 | 2/1972 | United Kingdom . | |
| 1309257 | 3/1973 | United Kingdom . | |
| 1465147 | 6/1973 | United Kingdom . | |
| 1407395 | 9/1975 | United Kingdom . | |
| 1462149 | 1/1977 | United Kingdom . | |
| 1514000 | 6/1978 | United Kingdom . | |
| 1525243 | 9/1978 | United Kingdom . | |
| 2027627 | 2/1980 | United Kingdom . | |
| 1577783 | 10/1980 | United Kingdom . | |

*Primary Examiner*—Peter K. Skiff

*Attorney, Agent, or Firm*—Frishauf, Holtz, Goodman & Woodward

[57] ABSTRACT

The austenite alloy tube has a composition of 15~26% of Cr, 8~35% of Ni, 1.0% or less of Si, 2.0% or less of Mn and less than 0.25% of N and the balance of iron and impurities. The nitrogen content on the inner surface of the tube is at least 0.25%. If desired, one or more of 0.6% or less of Ti, 0.6% or less of Al, 3.0% or less of Mo and 1.0% or less of Nb may be incorporated.

6 Claims, 5 Drawing Figures

AUSTENITE ALLOY TUBES HAVING EXCELLENT HIGH TEMPERATURE VAPOR OXIDATION RESISTANT PROPERTY

BACKGROUND OF THE INVENTION

This invention relates to an austenite alloy tube having an excellent high temperature vapor oxidation resistant property and contemplates improvement of high temperature steam oxidation resistant property of an austenite alloy tube including an austenite stainless steel tube utilized in a boiler or the like and subjected to high temperature steam thereby decreasing the amount of scale formed by high temperature steam.

As is well recognized in the art an austenite stainless tube utilized in a boiler forms a large quantity of scale on the inner surface of the tube owing to the oxidation action of steam at a temperature of 500° C. to 700° C., usually 550° C. to 650° C. The scale thus formed peels off due to the difference in the thermal expansion coefficients of the tube and the scale at the time of starting and stopping the boiler thus causing trouble during the boiler operation. Heretofore, various proposals have been made to prevent formation of oxide scale caused by high temperature steam. Among these proposals are included a method of plating chromium on the inner surface of the tube, use of an alloy containing a large quantity of chromium (for example, 25% chromium—20% nickel steel) or fine grain steel and a method of subjecting the tube inner surface to shot working. Among these only the fine grain steel and shot working have been practically used.

However, even when fine grain steel (for example SUS347 steel) is used it is not always effective and its type is limited. Alloys subjected to shot working greatly decreases its advantageous effect when subjected to high temperature hysteresis. Although various methods of decreasing the disadvantage have been investigated, crystal size and degree of working are limited.

SUMMARY OF THE INVENTION

Accordingly it is an object of this invention to obtain an austenite alloy tube having excellent high temperature vapor oxidation property so that it is suitable for use in a high pressure boiler.

Another object of this invention is to provide a ferrous type alloy tube having excellent workability and weldability and improved creep characteristic.

According to this invention, there is provided an austenite alloy tube having excellent high temperature steam oxidation resistant property having a composition of 15~26% by weight of chromium, 8~35% by weight of nickel, 1.0% or less by weight of silicon, 2.0% or less by weight of manganese, less than 0.25% by weight of nitrogen and the balance of iron and impurities, the tube having an estimated nitrogen concentration of 0.25% or higher by weight on the inner surface of the tube.

If desired, one or more of 0.6% or less by weight of titanium, 0.6% or less by weight of aluminum, 3% or less by weight of molybdenum and 1.0% or less by weight of niobium may be incorporated.

DESCRIPTION OF THE PREFERRED EMBODIMENTS

Figure 1:
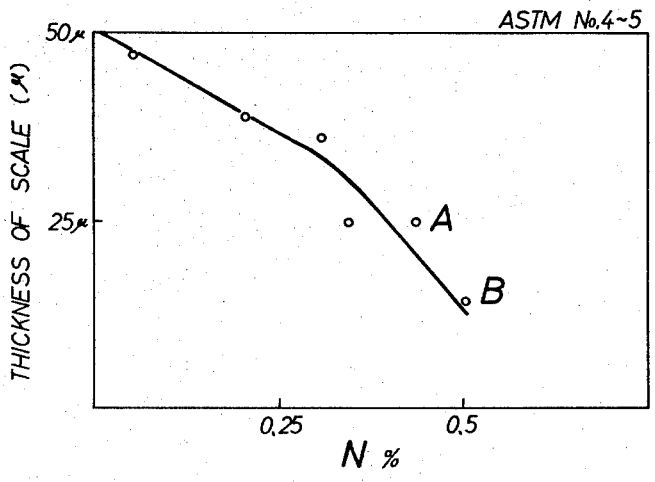
FIG. 1 is a graph showing the quantity of oxide scale of a steel alloy containing 18% of Cr, 12% of Ni and 0.05% of C when the content of nitrogen of the steel is varied under a condition in which the steel alloy is subjected to high temperature steam.

The percentages of respective elements are weight percentages unless otherwisely specified.

The percentages of respective elements recited in the accompanying claims are limited for the following reasons.

More particularly, the content of Cr should lie in a range of from 15% to 26%. Chromium content of less than 15% decreases corrosion resistant property, whereas Cr content of higher than 26% degrades high temperature characteristics. 8% or more of Ni is essential to realize adequate heat resistant property, but incorporation of Ni higher than 35% is not economical and degrades workability.

Incorporation of Si of 1% or less and Mn of 2% or less is essential for deoxidation and desulphurization. Incorporation of N of 0.25% or higher degrades workability. The quantity of N is usually at most 0.05% unless applying a carburization (nitriding) treatment to solid state steel the nitrogen content of which has been increased at the time of manufacturing steel.

In addition to the aforementioned basic elements, one or more of 0.6% or less of Ti, 0.6% or less of Al, 3.0% or less of Mo and 1.0% or less of Nb may be incorporated. With regard to Ti and Nb, at the time of recrystallization treatment, carbides, nitrides, and mixture thereof of these elements prevent growth of grains. Accordingly, so long as these elements are incorporated in amounts specified above, it is possible to attain a high temperature steam oxidation resistant property through a step of decreasing the grain size even with a lower nitrogen concentration on or near the inner surface of the tube. Incorporation of titanium is advantageous where it is desired to obtain sufficiently high creep property. Incorporation of Mo and Al in amounts specified above is necessary to attain the objects of this invention.

As above described, according to this invention nitrogen is nitrided into the inner surface of a steel alloy tube having above described composition so as to increase the quantity of N near the inner surface to at least 0.25%. Gas nitriding process utilizing ammonium gas or $N_2$ gas or salt nitriding process may be used. More particularly, the content of N of this type of steel can be usually increased to about 0.3% when it is mass produced, but when such high nitrogen content steel is used to prepare pipes used in boilers under high temperature steam condition, not only the workability but also the creep characteristic over a long time are not sufficient. For this reason, according to this invention the basic composition contains less than 0.25% of nitrogen and the inner surface of the tube is nitrided so as to increase the quantity of nitrogen near the inner surface of the tube to a value necessary to the tube.

When oxidation and pickling treatments are performed subsequent to the nitriding treatment, the nitrided layer is often removed to decrease steam oxidation resistant property. In such a case, surplus nitriding treatment is performed by anticipating more or less removal of the nitrided layer, so as to maintain the desired nitrogen concentration on or near the inner surface of the tube when it is actually used. In summary, the concentration of nitrogen on or near the inner surface of the tube is defined according to this invention when the tube is actually used. As above described, since the content of nitrogen on or near the inner surface of the tube is higher than that of the tube itself, when the tube is treated at a high temperature over a long time sufficient to diffuse the impregnated nitrogen the nitrogen content on or near the inner surface would decrease. For example, heat treatment at 1150° C. for one hour decreases the nitrogen content near the surface to one half, thus decreasing desired high temperature steam oxidation resistant property. For this reason, heat treatment over such long time should be avoided. Although it is not necessary to define the upper limit of the nitrogen content after the nitriding treatment, 1.5% is the practical upper limit when nitrogen is incorporated from gas or liquid. Even when carbon is incorporated together with nitrogen it does not affect the steam oxidation resistant property. When nitrogen is incorporated to a depth corresponding to one half of the thickness of the tube the mechanical characteristics of the tube are affected so that it is usually advantageous to limit the thickness of the nitrogen containing layer to be less than 1 mm.

The nitrogen concentration on or near the inner surface necessary to afford the required high temperature steam oxidation resistant property has a crystal grain size dependency prior to the actual use of the tube. When the grain size is normal, i.e., less than ASTM grain size No. 7 the estimated nitrogen content on the inner surface of the tube should be higher than 0.30% and that at a distance of 0.1 mm from the inner surface should be at least 0.30%. When the crystal grain size before the practical use is small, for example ASTM grain size of No. 7 or more the estimated nitrogen concentration on the inner surface of the tube should be at least 0.25% and that at a depth of 0.1 mm should be at least 0.25%. As above described, the nitrogen concentration on or near the inner surface necessary to impart the desired high temperature steam oxidation resistant property depends on the grain size prior to actual use and when the grain size becomes finer the same advantageous effect can be afforded even with a lower nitrogen concentration. In addition to the austenite alloy having a principal composition of Cr, Ni, Mn and Si, an alloy containing at least 0.05% of Nb wherein (Nb×2+Ti) is at least 0.2%, and 0.05% or more of carbon, and an alloy containing 0.2% or more of Ti and wherein (C+N) is made to be at least 0.05% are easy to make the crystal grain size to be 7 or more in ASTM No. at the time of solution heat treatment of the ingredients and at the time of nitriding so that it is advantageous to select such compositions.

From the standpoint of high temperature strength it is preferable to make small the grain size only near the inner surface of the tube rather than making small the grain size to be the ASTM No. 7 or higher throughout the thickness of the tube. For this reason, it is advantageous to incorporate carbon and nitrogen, by carburization or nitriding, in amounts sufficient to increase the quantities of carbide, nitride or mixtures thereof only near the inner surface of the tube so that the amounts of carbon and or nitrogen can satisfy the compositions described above.

In steel alloys containing 0.05% of C, 18% of Cr and 12% of Ni, we have varied the nitrogen contents of the steel alloy by incorporating ferrochrome nitride at the time of preparing molten alloy where it is heated to a temperature above 1050° C. (samples A and B were prepared by sealing solid steel alloy in a glass tube together with pure nitrogen and then uniformly nitriding the entire samples at a temperature higher than 1100° C). The crystal grain sizes of the tested samples were in a range of 4 to 5 in terms of ASTM No. These samples were exposed to high temperature steam at a temperature of 600° C. for 1000 hours. The graph shown in FIG. 1 shows the result of measurements of the degree of forming oxide scale. FIG. 1 shows that the steam oxidation resistant property is improved with increase in the nitrogen content and that when the quantity of nitrogen is increased above about 0.30% the quantity of the scale formed can be reduced to be less than 30 microns. Although the high pressure steam oxidation resistant property can be improved by increasing the content of nitrogen, when the entirety of the samples shown is nitrided the workability and the creep characteristic degrade. Only a portion which will become into contact with steam is required to be nitrided to manifest oxidation resistant property. Thus, in a tube it is necessary to nitride only the inner surface thereof or portions nearby. In such a case, nitriding is easy and it is easy to make relatively large the nitrogen content of such portion.

Figure 2:
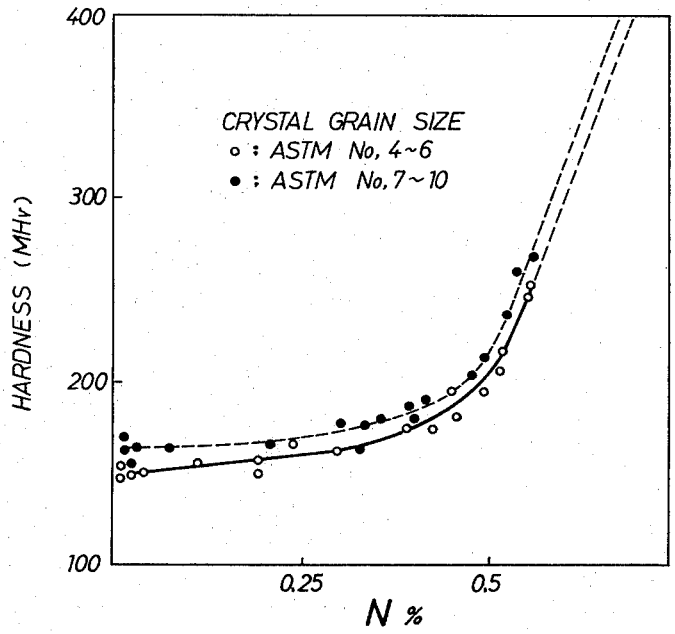
FIG. 2 is a graph showing the relationship between the hardness and the content of nitrogen of steel alloys containing fine particles and particles of ordinary size respectively and subjected to nitriding treatment under solid state.

FIG. 2 shows the relationship between the nitrogen content and hardness of a first austenite steel sample having a composition of 18% of Cr, 10% of Ni, 0.3% of Ti and 0.05% of C (shown by small circles) and a second austenite steel sample having a composition of 18% of Cr, 10% of Ni, 0.2% of Ti, 0.06% of C and 0.04% of N (shown by black dots). Both samples were solution treated at a temperature of higher than 1050° C. and then nitrided at a solid state to make uniform the nitrogen content throughout the samples. At this stage the former had a grain size of ASTM Nos. 4~6 and the latter had a grain size of Nos. 7 and 8. Curves shown in FIG. 2 shows that in both samples, the hardness quickly increases with the nitrogen content.

Figure 3:
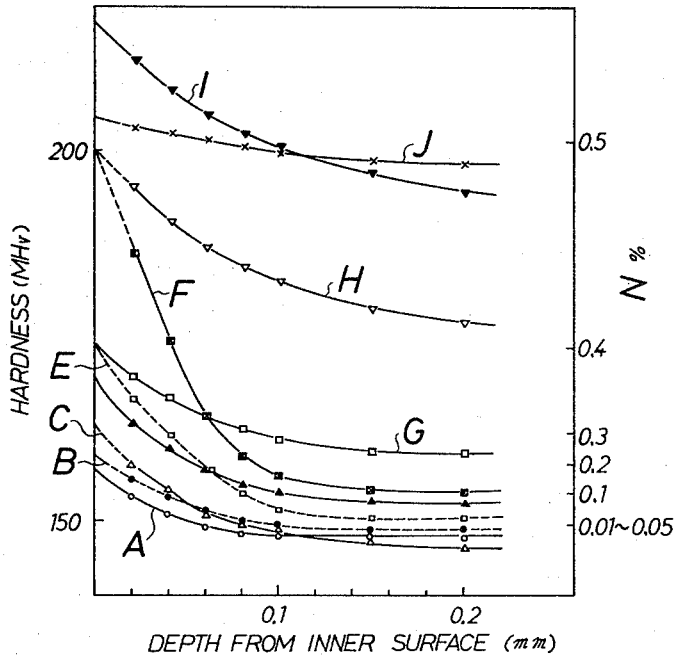
FIGS. 3 and 4 are graphs showing the relationship between the nitrogen quantity distribution and hardness of steel tubes (ASTM Nos. 4~6) containing 18% of Cr, 10% of Ni, 0.3% of Ti and 0.05% of C, the inner surfaces of the steel tubes having been subjected to nitriding treatment.
Figure 4:
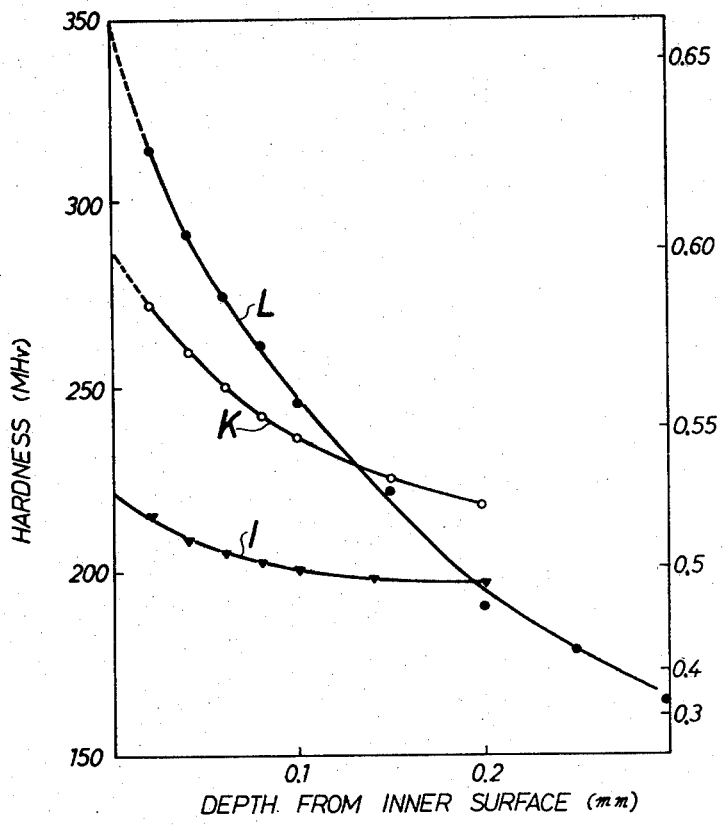

When a steel tube having a composition of first sample was subjected to a solid solution treatment after cold rolling and then nitrided with $N_2$ gas to obtain steel tubes A through K having different nitrogen content. FIGS. 3 and 4 show the relationship among hardness, nitrogen content, and the depth from the inner surface of these tubes having ASTM grain size numbers 4~6. Where the nitriding treatment is performed on the inner surface of the tube, the nitrogen content is the maximum at the inner surface which was in direct contact with nitrogen and the nitrogen content decreases toward the inside of the tube wall.

As it is impossible to continuously analyze the nitrogen content from the inner surface of the tube toward the inside, in this description, the nitrogen content on or near the inner surface of the tube sufficient to impart desired high temperature steam oxidation resistant property for the alloys having above described compositions is qualitatively expressed according to the following two parameters.

(1) estimated nitrogen concentration $N_E$ on the inner surface (2) nitrogen concentration within 0.1 mm $N_A$ (1) $N_E$ As shown in FIG. 2, the hardness increases with the nitrogen content. As a consequence, when the relation between the nitrogen content and the hardness of a certain austenite steel or alloy is predetermined, then it becomes possible to obtain the nitrogen concentration distribution in a cross-section of a tube by measuring the hardness in the cross-section.

Although it is considered that the nitrogen content at a portion close to the inner surface governs the high temperature steam oxidation resistant property, the hardness of the inner surface itself is impossible to measure. Accordingly, we propose to apply to the tube inner surface a hardness distribution curve obtained by measuring the hardness from the inner surface to a depth of 0.1 mm at a spacing of 0.02 mm to estimate the surface hardness or the nitrogen content $N_E$ on the inner surface and to investigate the relationship between the nitrogen content and the high temperature steam oxidation resistant property.

(2) $N_A$

It is easy to determine the nitrogen content of a portion of the nitrided tube near the inner surface thereof by cutting the portion with a bite and then analyzing. As has been pointed out hereinabove the nitrogen content generally decreases from the inner surface of the tube which was in direct contact with nitrogen toward inside so that it is advantageous to make thin as far as possible the thickness of the portion cut by the bite. Actually, the minimum thickness that can be cut with a bite is about 0.1 mm we propose to cut by 0.1 mm the inner surface and to chemically analyze the composition of the chip so as to qualitatively represent the nitrogen content of the portion near the inner surface based on the result of analysis.

This can be noted from FIGS. 3 and 4 that even over a distance of only 0.1 mm from the inner surface, the hardness or the nitrogen content substantially varies. The parameter $N_A$ is intended to represent the nitrogen content of a portion near the inner surface by an average value over this distance.

The following Table I shows the thickness of the scale formed after the high temperature steam oxidation resistant property test made at 600° C. for 1000 hours with reference to sample steel tubes A~K and a control tube not subjected to nitriding treatment and parameters $N_A$ and $N_E$ of respective tubes.

TABLE I

| sample | $N_A$ nitrogen content within 0.1 mm | $N_E$ estimated nitrogen content on the surface | thickness of oxide scale |
|---|---|---|---|
| A | 0.06% | 0.15% | 45μ |
| B | 0.08% | 0.20% | 36μ |
| C | 0.08% | 0.30% | 30μ |
| D | 0.22% | 0.35% | 29μ |
| E | 0.26% | 0.40% | 22μ |
| F | 0.35% | 0.40% | 25μ |
| G | 0.35% | 0.50% | 19μ |

TABLE I-continued

| sample | $N_A$ nitrogen content within 0.1 mm | $N_E$ estimated nitrogen content on the surface | thickness of oxide scale |
|---|---|---|---|
| H | 0.45% | 0.50% | 17μ |
| I | 0.51% | 0.50~0.55% | 14μ |
| J | 0.48% | 0.50% | 16μ |
| K | 0.57% | 0.60% | 13μ |
| L | 0.59% | 0.65% | 9μ |
| M (control) | 0.01% | 0.01% | 50μ |

Table I shows that there is a tendency that $N_E$ increases with $N_A$ with the result that the thickness of the scale decreases. It is to be understood that $N_A$ and $N_E$ are not always in a ratio of 1:1. For example, in sample steel tubes B and C $N_A$ is 0.08% but $N_E$ shows different values of 0.20% and 0.30%. This is caused by the fact that even though the average nitrogen content is the same over a distance of 0.1 mm from the inner surface the distribution of nitrogen over this distance is different. For example, as shown in FIG. 3, although the estimated nitrogen content at a distance of 0.1 mm from the inner surface is lower in tube C than in tube B, the gradient of the nitrogen concentration is larger in a region within 0.1 mm, and the estimated nitrogen content on the inner surface is higher in tube C than in tube B. Even in steel tubes having the same value of parameter $N_A$, those having larger gradient of nitrogen concentration over distance of 0.1 mm and hence larger estimated nitrogen concentration on the inner surface have larger high temperature steam oxidation resistant property. The same is true for sample steel tubes F and G. To more strictly discuss the high temperature steam oxidation resistant property, it seems better to consider $N_E$ rather than $N_A$. Since the thickness of the scale formed on SUS347 steel known to have excellent high temperature steam oxidation resistant property under conditions of 600° C. and 1000 hours usually ranges from 30μ to 40μ, it will be clearly understood that, in order to limit the thickness of the scale formed under the same conditions to be less than 30μ it is necessary to make $N_E$ to be at least 0.30%. As had described, with $N_A$ of 0.30%, the estimated nitrogen content $N_E$ on the surface is 0.30% or more. When one compares the high temperature steam oxidation resistant property of two steel tubes having the same values of $N_A$ and $N_E$ of $\alpha$, he will find that a steel tube whose $N_A$ is $\alpha$ has better property. (Compare tubes D and F or G shown in FIG. 1.) In order to determine the parameter $N_E$ it is necessary to prepare similar austenite type ferrous alloys, to nitride them to have different nitrogen content and then to determine their hardness. In addition, it is also necessary to determine the cross-sectional hardness before practical use. However, this is troublesome. For this reason, we prefer to define a preferred range of at least 0.30% for $N_A$.

Since the hardness of the inner surface is difficult to measure, the righthand ordinate in FIGS. 3 and 4 is graduated with nitrogen quantity based on the relation between nitrogen quantity and the hardness shown in FIG. 2. By utilizing the chip formed by cutting the inner side of the tube by 0.1 mm, nitrogen was analyzed, and the hardness of the inner surface (of the tube) was calculated from extensions of respective curves and nitrogen content on the inner surface was determined from this calculated hardness.

Figure 5:
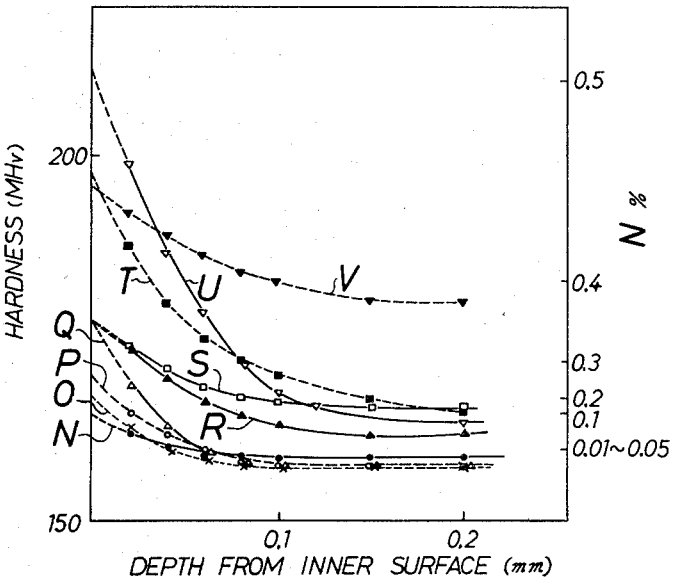
FIG. 5 is a graph showing the relation between the nitrogen quantity distribution and the hardness of a steel alloy containing fine particles as defined in ASTM Nos. 8~10.

The samples shown in FIGS. 3 and 4 have an ordinary grain size of ASTM Nos. 4~6 prior to use, whereas the samples shown in FIG. 5 have a fine grain size of ASTM Nos. 8~10 after nitriding. Sample steel tubes N, O, U and V have composition of 18% of Cr, 10% of Ni, 0.1% of Nb, and 0.05% of C, while sample steel tube S has a composition just mentioned and further incorporated with 0.1 of Ti. The grain size before use of these samples is ASTM No. 8. Sample steel tubes P, Q, R and T have a composition of 18% of Cr, 10% of Ni, 0.06% of C, 0.04% of N (from the inner surface to a depth of 0.4 mm) and 0.2% of Ti, and have a fine grain size of ASTM No. 9 near the inner surface and grain size of ASTM Nos. 4 and 5 at the central portion and at the outer portion. These samples were prepared by cold rolling, impregnating nitrogen in an amount of 0.04% at the time of intermediate annealing, suppressing grain growth of the inner surface at the time of solution heat treatment to form only fine grains, and then nitriding in the same manner as in the cases shown in FIGS. 3 and 4. The control sample W is SUS347 material, i.e., having a composition of 18% of Cr, 12% of Ni, 0.05% of C and 0.6% of Nb and a grain size of ASTM Nos. 8 and 5. Like Table I, $N_A$ and $N_E$ and high temperature steam oxidation resistant property under conditions of 600° C. and 1000 hours of samples N~W are shown in the following Table II.

TABLE II

| sample | $N_A$ nitrogen content within 0.1 mm | $N_E$ estimated nitrogen content on the surface | thickness of scale |
|---|---|---|---|
| N | 0.06% | 0.25% | 25μ |
| O | 0.06% | 0.1% | 33μ |
| P | 0.06% | 0.35% | 20μ |
| Q | 0.06 | 0.25% | 25μ |
| R | 0.05 | 0.20% | 31μ |
| S | 0.15% | 0.36% | 19μ |
| T | 0.25% | 0.35% | 22μ |
| U | 0.35% | 0.47% | 17μ |
| V | 0.41% | 0.49% | 15μ |
| W (control) | 0.01% | 0.01% | 30~35μ |

In these cases, when the estimated nitrogen content on the surface is made to be 0.25% or higher it is possible to reduce the thickness of the scale formed under the conditions described above. It can be noted that where $N_A$ is made 0.25% or higher, the high temperature steam oxidation resistant property can be improved.

Some examples of the blank other than those described above were also investigated and their test results are shown in the following Table III. Each sample was prepared by cold rolling, intermediate annealing, and final annealing (solution heat treatment) together with nitriding treatment. Sample A had a composition of 23% of Cr, 35% of Ni, 0.05% of C, 0.6% of Ti and 0.6% of Al, and a grain size of ASTM No. 5. This sample was nitrided and then subjected to a high temperature steam oxidation resistant test. Sample B had a composition of 26% of Cr, 22% of Ni and 0.05% of C while samples C and D had a composition of 18% of Cr, 10% of Ni and 0.05% of C. These samples had a grain size of ASTM No. 5. Samples B and C were tested as nitrided, while D was tested after descaling with a mixture of $HNO_3$ and HF. Sample F had a composition of 18% of Cr, 12% of Ni, 0.05% of C and 0.7% of Nb and a grain size of ASTM No. 8 and descaled. Samples F and G had a composition of 17% of Cr, 12% of Ni, 0.06% of C and 2.5% of Nb and a grain size of ASTM No. 4. Sample F was tested as nitrided and sample G was tested after nitriding and descaling.

TABLE III

| sample | $N_A$ nitrogen content within 0.1 mm | $N_E$ estimated nitrogen content on the surface | thickness of scale |
|---|---|---|---|
| A | 0.1% | 0.35% | 4μ |
| B | 0.2% | 0.35% | 4μ |
| $C_1$ | 0.2% | 0.40% | 22μ |
| $C_2$ | 0.25% | 0.35% | 25μ |
| $C_3$ | 0.30% | 0.50% | 20μ |
| D | 0.4% | 0.5% | 21μ |
| $E_1$ | 0.15% | 0.25% | 25μ |
| $E_2$ | 0.25% | 0.40% | 19μ |
| $E_3$ | 0.3% | 0.40% | 20μ |
| F | 0.25% | 0.4% | 25μ |
| G | 0.24% | 0.38% | 27μ |

The parameters $N_A$ and $N_E$ shown in Table III were obtained respectively after nitriding and descaling that is immediately prior to the high temperature steam oxidation resistant test. In samples A and B, the thickness of the scale is only 4μ. This was caused by the fact that the Cr content of these samples are much higher than in other samples. The thickness of the scale of these samples (not nitrided) was about 10μ under the same condition of the steam oxidation resistant test.

Each of the samples shown in Table III has a composition as defined in the appended claim. Since samples A~D, F and G having a crystal grain size of less than 7 in term of ASTM number after nitriding and prior to use have a value of $N_E$ of higher than 0.30% required by this invention so that their high temperature steam oxidation resistant property is excellent. Sample F having a crystal grain size of ASTM No. 8 prior to the use satisfies the values of $N_A$ and $N_E$ after descaling as specified by this invention, so that it also manifests excellent high temperature steam oxidation resistant property.

As above described, according to this invention there is provided an austenite alloy tube having a specific composition with the inner surface nitrided so as to provide a surface nitrogen concentration of 0.25% or more which is estimated from the hardness distribution of a portion near the inner surface. Accordingly the austenite alloy tube of this invention has excellent workability, weldability, creep characteristic and high temperature steam oxidation resistant property. Thus, the tube of this invention is suitable for use in various types of boilers and various products subjected to high temperature steam.

What is claimed is:

1. An austenite alloy tube having excellent high temperature steam oxidation resistant properties having a composition comprising 15 to 26% by weight of chromium, 8 to 35% nickel, silicon in an amount up to 1%, manganese in an amount up to 2%, said tube having an average nitrogen content of less than 0.25%, and having a nitrogen content of 0.25% or higher on the inner surface of said tube, said inner surface having been nitrided to provide said higher nitrogen content, and the balance of said tube being iron and impurities.

2. The austenite alloy tube of claim 1 wherein said composition further comprises at least one of titanium in an amount up to 0.6%, aluminum in an amount up to 0.6%, molybdenum in an amount up to 3%, and niobium in an amount up to 1%.

3. The austenite alloy tube of claim 1 wherein said tube has a grain size of less than 7 in ASTM No.

4. The austenite alloy tube of claim 1 wherein said tube has a grain size of 7 or more in ASTM No. and said nitrogen concentration on the inner surface of said tube is 0.3% or higher.

5. The austenite alloy tube of claim 1 or 2 wherein the average nitrogen content of the portion of the tube from the inner surface thereof to 0.1 mm into the tube from the inner surface is at least 0.25% nitrogen.

6. The austenite alloy tube of claim 1 or 2 wherein said nitrogen content on the inner surface of said tube is an estimated nitrogen content determined by measuring the hardness of samples taken from the inner portion of the tube, plotting the measured hardness of said samples to obtain a hardness distribution curve of the tube near the inner surface thereof, estimating the hardness on the inner surface of the tube from said curve and then estimating the nitrogen content on the inner surface of the tube from a pre-obtained curve correlating the hardness of this portion of the tube to the nitrogen content thereof.

* * * * *